US005862811A

United States Patent [19]

Steele

[11] Patent Number: 5,862,811

[45] Date of Patent: Jan. 26, 1999

[54] NAIL REPAIR KIT AND METHOD

[76] Inventor: Patricia A. Steele, 6437 Gaynell Ave., Milton, Fla. 32570

[21] Appl. No.: 79,613

[22] Filed: May 15, 1998

[51] Int. Cl.[6] ..... A45D 29/18

[52] U.S. Cl. ..... 132/200; 132/73.5; 132/73

[58] Field of Search ..... 132/200, 73, 73.5, 132/75.6

[56] References Cited

U.S. PATENT DOCUMENTS

| | | | |
|---|---|---|---|
| 3,228,404 | 1/1966 | Turner | 132/73 |
| 3,425,426 | 2/1969 | Welanetz | 132/73 |
| 4,249,551 | 2/1981 | Nordstrom | 132/73 |
| 4,299,243 | 11/1981 | Umstattd | 132/73 |
| 4,450,848 | 5/1984 | Ferrigno | 132/73 |
| 5,005,595 | 4/1991 | Aylott | 132/73 |
| 5,088,509 | 2/1992 | Savage, III | 132/73.5 |
| 5,139,036 | 8/1992 | Pickard | 132/73.5 |
| 5,146,935 | 9/1992 | Rumore et al. | 32/73 |
| 5,638,837 | 6/1997 | Juhl et al. | 132/285 |

FOREIGN PATENT DOCUMENTS

| | | | |
|---|---|---|---|
| 4335527 | 2/1994 | Germany | 132/73 |

OTHER PUBLICATIONS

"SCOTH brand cellophane tape" advrtisement, Colliers (1 sheet) May 1949.

"Bekcy Lynn" jewel silk overlay kit advertisement (1 sheet) Oct. 1989.

*Primary Examiner*—Todd E. Manahan

*Attorney, Agent, or Firm*—Joseph N. Breaux

[57] ABSTRACT

A finger and toe nail repair kit and method wherein the kit comprises an adhesive which will both bond natural nail material and dissolve polystyrene, a multiplicity of polystyrene pellets, a cuticle stick, a buffing board with sufficient grit to grind a dried mixture of adhesive and polystyrene, and a buffing block to remove the shine from the nail after mending the nail and in preparation for a coating as desired. While the method comprises the placing adhesive directly in a crack or tear of a nail to be repaired, placing a polystyrene pellet longitudinally within the crack or tear while the adhesive is still wet, using the cuticle stick pressing the polystyrene pellet into the wet adhesive and crack or tear area allowing a portion of the pellet to be dissolved and become mixed with the adhesive and allowing the dissolved polystyrene and adhesive mixture to flow into the crack or tear, allowing the polystyrene and adhesive mixture to dry, removing the portion of the polystyrene pellet not dissolved by the adhesive, grinding the dried adhesive and polymer mixture to a desired level with the natural nail surface, buffing the nail surface to remove shine and prepare the nail for a desire coating.

5 Claims, 2 Drawing Sheets

NAIL REPAIR KIT AND METHOD

TECHNICAL FIELD

The present invention relates to devices and methods for nail repair kits and particularly to devices and methods for repairing finger and toe nails which includes a means for repairing torn or cracked nails by use of an adhesive and polystyrene filling material for nonconformed nail surfaces whereby the adhesive and polystyrene react to form the filling material which permeates the nonconformed nail surface bonding to the nail which both adheres and fills in the nail cracks, which is shaped by filing and then coated.

BACKGROUND ART

Cracked or torn finger or toe nails have long been problems which are difficult to repair quickly and with sufficient strength. Improved adhesives and filling materials have allowed most cracked nails to effectively repaired, however these methods and materials are cumbersome to use because their components are not easily handled. Powered fillers and sticky adhesives are sometimes required to be mixed prior to use and then applied to the cracked nail, handling powders is extremely difficult and mixing the components takes time, while the mixing time or technique may vary resulting in inconsistent final products. Another problem with prior devices and techniques is the difficulty of directly applying the mixed filler and/or adhesive to the crack or the area to be filled. Prior art which has addressed these problems and others include the following:

Juhl et al., U.S. Pat. No. 5,638,837 which discloses a device which shields a portion of a finger nail to prevent nail polish from being applied to the shielded portion.

Rumore et al., U.S. Pat. No. 5,146,935 discloses a method for repairing finger nails which comprises a plurality of pre-sized nail patches which are ready to fit a damaged nail which assist in repairing nail cracks while a wrap is applied over the patch.

Aylott, U.S. Pat. No. 5,005,595 discloses a nail repair device for repairing split or broken finger nails which comprises a support portion for fitting under a nail and a handle portion extending from the support portion, the device supports a nail while the nail is mended with adhesive or the like.

Ferrigno, U.S. Pat. No. 4,450,848 discloses an artificial finger nail forming method and kit which comprises artificial finger nail tips, adhesive for adhering the artificial tip to the natural portion of the finger nail, and a finger nail leveling component comprising a first coat of adhesive followed by adding powdered acrylic ester polymer and then followed by another coat of adhesive over the powered polymer.

Nordstom, U.S. Pat. No. 4,249,551 discloses a finger nail reconstruction kit comprising a pair of containers for containing chemical components which are used for finger nail construction. The containers provide an easier means for dispensing the chemicals without spilling, dripping and exposing the chemicals to the atmosphere.

Turner, U.S. Pat. No. 3,228,404 discloses method for protecting, repairing and lengthening the life of fingernails by applying a coat of synthetic plastic cement over the entire exposed surfaces of the fingernail and then followed by a coat of cellulosic liquid material and then finally followed by a liquid sealer.

These prior devices are very useful for the particular problems they address, however they do not provide an effective means of applying fingernail crack repair material directly to and within the crack on the fingernail as the present device. The present invention overcomes the problem of applying impermeable polymers over the entire surface of a fingernail in order to repair a single crack. The present invention accomplishes this by supplying a repair kit which includes an adhesive which is applied directly to the damaged area of the fingernail, polystyrene filler pellets which are used to be pressed into the adhesive filled crack thereby dissolving a portion of the polystyrene pellet in contact with the adhesive so that the polystyrene and adhesive mix and flow into the crack and quickly harden, the undissolved polystyrene pellet portion is then broken off, the filled area is filed or ground to be level with the natural nail surface and then coated as desired. The present invention does not use a powdered component for filling avoiding the mess associated with mixing or handling powders.

GENERAL SUMMARY DISCUSSION OF INVENTION

It is thus an object of the invention to provide a Nail Repair Kit and Method that comprises a method for repairing and filling cracked or damaged finger or toe nails that does not include powdered fillers which must be mixed with adhesives or applied to the nail, while the method provides a convenient means of applying repair materials directly to the damaged area of the nail.

It is a further object of the invention to provide a Nail Repair Kit and Method that provides an adhesive which is applied directly to or in a crack or tear on a finger or toe nail while a polystyrene pellet is then pressed into the adhesive filled crack or tear allowing the adhesive to dissolve a contacted portion of the polystyrene pellet, allowing the adhesive and polystyrene mixture to dry, the excess polystyrene is then removed and the repaired portion is then ground or filed to smoothness with the natural portion of the nail.

It is a still further object of the invention to provide a Nail Repair Kit that includes an adhesive which has chemical properties that include adhesion with natural nail material and also an ability to dissolve polystyrene, a multiplicity of polystyrene pellets, and a buffing block with sufficient grit to remove the dry adhesive polystyrene mixture to the level of the natural nail.

It is a still further object of the invention to provide a Nail Repair Method for repairing torn or cracked finger or toe nails wherein the method comprises the steps, applying an adhesive directly on the tear or crack on the nail, pressing a polystyrene pellet into the wet adhesive on the nail tear or crack causing a portion of the polystyrene pellet to contact the wet adhesive thereby dissolving a portion of the pellet and forcing the dissolved polystyrene and adhesive to mix and flow into the tear or crack, allowing the adhesive and polystyrene mixture to dry, removing the portion of the polystyrene which did not contact the adhesive, grinding or filing the dried adhesive and polystyrene to be level with the natural nail surface, and finally coating the repaired nail as desired.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the preceding description that the finger and toe nail repair kit and method which comprises an adhesive suitable for adhering natural toe and/or finger nail material along with a solvent in such adhesive which dissolves polystyrene are used in combination to both adhere and fill damaged finger and/or toe nails.

Figure 1:
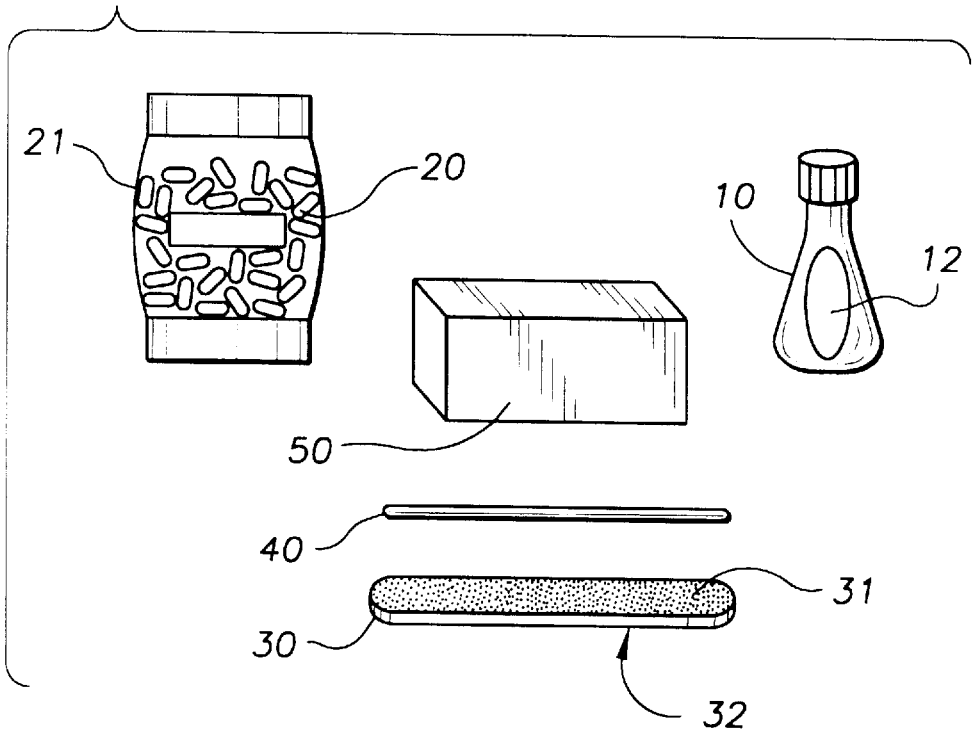
FIG. 1 is an illustration of the components of the kit for repairing nails comprising, nail adhesive, polystyrene pellets, a buffing block, a buffing board and a cuticle stick.
Figure 2:
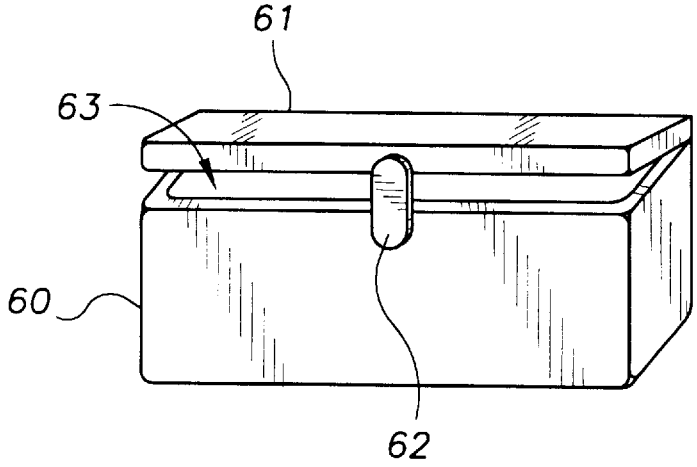
FIG. 2 is a container for containing the components of the kit.

Referring to the figures in detail, FIG. 1 illustrates an adhesive 12 within container 10, a multiplicity of polystyrene pellets 20 contained within a polystyrene pellet container 21, a buffing board 30 with gritted surfaces 31 and 32 sufficient to grind dried adhesive and a mixture of dissolved polystyrene and dried adhesive, and natural fingernail. Cuticle stick 40 is coated with a non-adhesive adhering coating while buffing block 50 is used for removing a shine from a natural finger nail surface. A rectangular kit component container 60 for containing the kit components is illustrated in FIG. 2. The adhesive 12 is preferably suitable for strongly bonding natural finger or toe nail material while also having the capabilities for its solvent to dissolve polystyrene. Additionally, the adhesive 12 should be a fast drying adhesive which dries in preferably less than 2 minutes when exposed to ambient temperatures and pressures. The solvent for the adhesive is preferably selected from a group consisting of aromatic ketones, aliphatic ketones, aromatic hydrocarbons, alkyl aromatic hydrocarbons, aliphatic hydrocarbons and combinations thereof. As mentioned above, the adhesive 12 is thinned with a solvent which falls within one of the selected groups. The inventor has found that one of the mentioned hydrocarbon solvents is preferable because it lends itself to dissolving polystyrene rapidly on contact. The adhesive 12 is further contained within a container 10 which includes a means for easily dispensing the adhesive, the dispensing means may include a brush attached to the end of a cap, or a dripping means made continuously as part of the container so that the adhesive can be selectively dropped from the container to a desired location. The dispensing means must also provide a means for dispensing minute quantities of adhesive on a desired location without inadvertently spilling adhesive on undesirable locations. In practice, the adhesive is applied directly on a crack and/or tear in a fingernail or toenail. It is preferable that the adhesive is applied to the entire length of the tear and/or crack.

The polystyrene pellets have a length of about three to five millimeters and a diameter of about one half to about two millimeters. The polystyrene which is used to form the pellets may also include a color additive which preferably tints the color of the pellet to match the natural color of a fingernail. The additives may include oxides of iron to achieve a desired tint. The polystyrene pellets 20 are further contained within a pellet container 21 which is dimensioned to fit within the interior of kit component container 60.

The buffing board 30 includes gritted surfaces 31 and 32 which is used to grind excessive dried adhesive and/or dried mixture of adhesive and dissolved polystyrene. The buffing board is an elongated board approximately two to six inches long with two opposed surfaces wherein one surface 31 is arched to provide buffing services for varying shapes of a fingernail. While an underside of the buffing board 32 is substantially flat providing options for the user in grinding irregular surfaces of the fingernail or toenail damaged.

The cuticle stick 40 is preferably constructed of a rigid material such as wood, aluminum, stainless steel or an assortment of polymers consisting of polyethylene or polypropylene. Furthermore, the cuticle stick 40 may be composed of a material such as wood or metal and then coated with a coating which does not adhere to the adhesive 12. The coating may include TEFLON™, NYLON™, or any other nonstick surface allowing the cuticle stick to be employed in contact with wet adhesive allowing the cuticle stick to be easily cleansed after use.

The buffing block 50 is preferably a grit impregnated rigid foam block which is known by those skilled in the art for removing a shine from a natural finger or toe nail surface. The buffing block 50 is used to ready the fingernail or toenail surface for coating a desired fingernail polish and/or coating.

Figure 3:
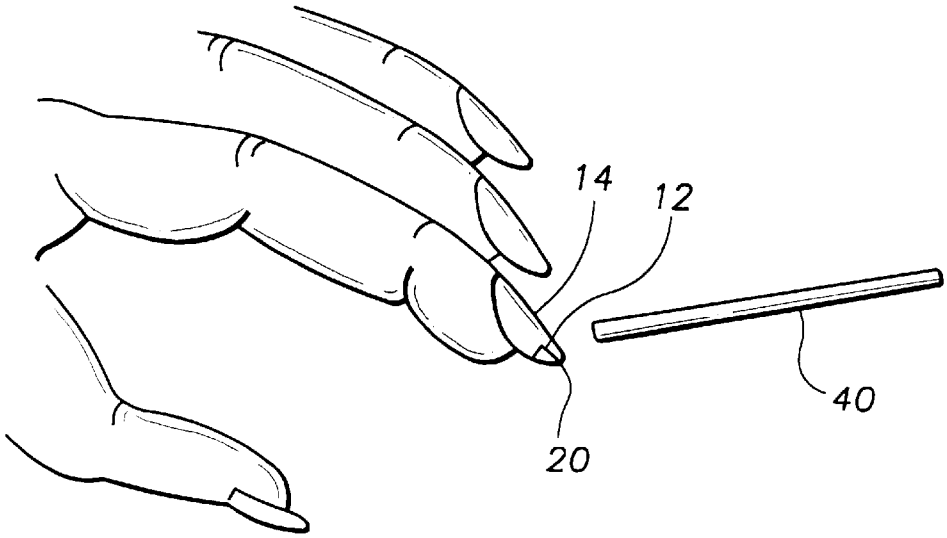
FIG. 3 is an illustration of the placement of a polystyrene pellet in place on a finger utilizing the cuticle stick to hold the pellet in position until dry.
Figure 4:
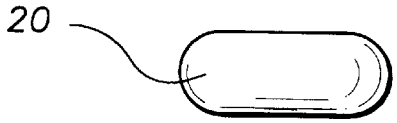
FIG. 4 is a side view of a polystyrene pellet.
Figure 5A:
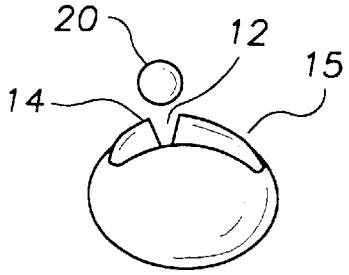
FIGS. 5*a*–5*c* are end views of a finger and fingernail illustrating the placement of the polystyrene pellet on a crack filled with adhesive, dissolving and mixing the polystyrene pellet in the adhesive in the crack, and removal of the nondissolved pellet portion after the adhesive and polystyrene mixture have dried.
Figure 5B:
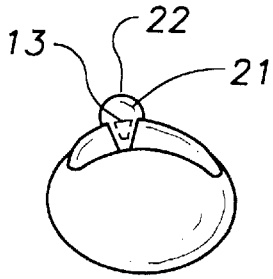
Figure 5C:
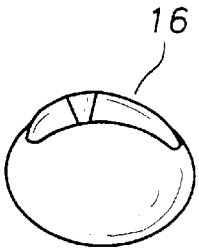

In use, as illustrated in FIG. 5*a*, the adhesive 12 is applied to a crack 14 in a fingernail 15. While the adhesive 12 is still wet, polystyrene pellet 20 is placed longitudinally over the adhesive 12 wetted crack 14. Using the cuticle stick 40, as illustrated in FIG. 3, the polystyrene pellet 20 is pushed into intimate contact with the adhesive within the fingernail crack 14 to ensure that the polystyrene pellet 20 contacts and is dissolved by as much adhesive solvent 12 as possible. FIG. 5*b* illustrates a partially dissolved polystyrene pellet 20 which has mixed with the adhesive 12 to form a filling material 13 within the fingernail crack 14. The adhesive 12 and the mixture of dissolved polystyrene and adhesive 13 is allowed to dry. The inventor has found that the use of a fast drying adhesive which dries in approximately 2 minutes is particularly suitable for this kit. After the adhesive 12 and mixture of adhesive and dissolved polystyrene 13 had cured the excessive portion of the polystyrene 22 is removed from the nail leaving the fingernail crack 14 filled with a dried mixture of adhesive and dissolved polystyrene, as illustrated in FIG. 5*c*. The buffing block 30 is then utilized to grind away excess dried adhesive, excess dried adhesive mixed with dissolved polystyrene down to a level even with the natural fingernail outer surface 16. The buffing block 50 is then utilized to remove any shine existing on the nail to ready the nail for coatings such as nail polish and other types of coatings useful on finger and/or toe nails.

The kit component container 60 is preferably dimensioned to receive the adhesive container 10 in a standing position so that it is not laid over and allowed to spill within the container. Additionally, the container has a hinged top 61 and a top latch 62 allowing easy access into the container and a means for latching the top in a closed position. Additionally the container preferably has an interior coating 63 which does not adhere to the adhesive used in the kit. This allows the cleaning of the interior of the container.

It is noted that the embodiment of the Nail Repair Kit and Method described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Nail Repair Kit comprising: an adhesive in a container wherein the adhesive adheres natural fingernail and toenail material and which includes a solvent which will dissolve polystyrene, a multiplicity of polystyrene pellets each pellet about 3 to about 6 millimeters long and about ½ to about 2 millimeters in diameter, a cuticle stick which is coated with a coating which does not adhere to the adhesive or to a mixture of the adhesive and dissolved polystyrene, a grinding block which has a gritted surface which will grind dried adhesive and further will grind a dried mixture of the adhesive and the dissolved polystyrene, a buffing block with a gritted surface which will remove a shine from a natural nail surface, and a rectangular storage container for storing the components, wherein said container storage comprises a hinged lid for entry into the container storage and an interior surface coating which does not adhere to the adhesive further wherein said container includes a height which allows placement of the adhesive container in the container in a standing position.

2. The Nail Repair Kit of claim 1, wherein the solvent for the adhesive is selected form a group consisting of aromatic ketones, cyclic aliphatic ketones, alkyl aromatic ketones, aliphatic ketones, aromatic hydrocarbons, alkyl aromatic hydrocarbons, aliphatic hydrocarbons and combinations thereof.

3. The Nail Repair Kit and Method of claim 1, wherein the cuticle stick is constructed of material selected from a group consisting of polyethylene, polypropylene, and polytetrafluoroethylene.

4. A Nail Repair Method for repairing damaged finger or toe nails which are either cracked or torn, comprising the steps: applying an adhesive suitable for bonding natural nail material and dissolving polystyrene directly to the damaged area of the nail to be repaired, before the adhesive dries applying a polystyrene pellet in contact with the adhesive and longitudinally aligned with the damaged area to be repaired, depressing the polystyrene pellet into the nondried adhesive so that the adhesive dissolves a portion of the polystyrene pellet and the dissolved polystyrene mixes with the adhesive, allowing the adhesive and the mixture of dissolved polystyrene and adhesive to dry, removing a portion of the polystyrene pellet which has not been dissolved by the adhesive leaving dried adhesive and dried mixture of dissolved polystyrene and adhesive, grinding the dried adhesive and dried mixture of polystyrene and adhesive so that a level of the dried adhesive and mixture of polystyrene and adhesive is even with a natural nail surface.

5. The Nail Repair Method of claim 4 wherein the method further comprises the step: holding the polystyrene pellet in place over the nondried adhesive with a cuticle stick until the adhesive and mixture of dissolved polystyrene and adhesive dries.

* * * * *